US009003969B2

(12) United States Patent
Marzin et al.

(10) Patent No.: US 9,003,969 B2
(45) Date of Patent: Apr. 14, 2015

(54) DEVICE FOR LOADING PRINTING PLATES ON A PLATE CYLINDER OF A ROTARY OFFSET PRESS

(71) Applicant: Goss International Corporation, Durham, NH (US)

(72) Inventors: Jacky Marzin, Nantes (FR); Jean-Luc Bailly, Gorges (FR); Philippe Lechat, La Chapelle sur Erdre (FR)

(73) Assignee: Goss International Corporation, Durham, NH (US)

( * ) Notice: Subject to any disclaimer, the term of this patent is extended or adjusted under 35 U.S.C. 154(b) by 0 days.

(21) Appl. No.: 13/751,101

(22) Filed: Jan. 27, 2013

(65) Prior Publication Data

US 2013/0291747 A1 Nov. 7, 2013

(30) Foreign Application Priority Data

Jan. 27, 2012 (FR) ..... 12 50813

(51) Int. Cl.

*B41F 27/06* (2006.01)
*B41F 27/12* (2006.01)
*B41F 27/00* (2006.01)

(52) U.S. Cl.

CPC ..... *B41F 27/06* (2013.01); *B41F 27/1206* (2013.01); *B41P 2227/11* (2013.01); *B41P 2227/62* (2013.01); *B41F 27/005* (2013.01); *B41F 27/1231* (2013.01); *B41P 2227/50* (2013.01)

(58) Field of Classification Search

CPC ..... B41F 27/1206; B41P 227/62
USPC ..... 101/477, 382.1
See application file for complete search history.

(56) References Cited

U.S. PATENT DOCUMENTS

| | | | | |
|---|---|---|---|---|
| 3,135,027 | A * | 6/1964 | Squires | 52/204.5 |
| 6,299,572 | B1 * | 10/2001 | Harari | 493/320 |
| 6,439,117 | B1 * | 8/2002 | Dumais et al. | 101/383 |
| 7,647,868 | B2 * | 1/2010 | Schneider et al. | 101/477 |
| 7,934,452 | B2 * | 5/2011 | Faist | 101/477 |
| 8,286,553 | B2 * | 10/2012 | Faraz | 101/485 |
| 2002/0144618 | A1 * | 10/2002 | Fukui | 101/477 |
| 2006/0191434 | A1 * | 8/2006 | Schneider et al. | 101/477 |
| 2008/0078298 | A1 * | 4/2008 | Iwamoto | 101/477 |
| 2009/0255429 | A1 * | 10/2009 | Hofmann | 101/477 |
| 2010/0018422 | A1 * | 1/2010 | McGaire | 101/477 |

* cited by examiner

*Primary Examiner* — Anthony Nguyen
(74) *Attorney, Agent, or Firm* — Davidson, Davidson & Kappel, LLC

(57) ABSTRACT

The loading device according to the invention comprises a magazine for receiving at least one printing plate and transferring it from the magazine to the plate cylinder. It also comprises at least one guide rail to guide a printing plate during transfer thereof by cooperation with a notch of a front edge of the printing plate, the notch sliding along the guide rail during the transfer.

13 Claims, 4 Drawing Sheets

DEVICE FOR LOADING PRINTING PLATES ON A PLATE CYLINDER OF A ROTARY OFFSET PRESS

The present invention relates to a device for loading printing plates on a plate cylinder of a rotary offset press.

A rotary offset press comprises printing units, for example for printing a continuous strip of material. Each printing unit is provided to print a pattern on one surface of the strip.

Each printing unit comprises a plate cylinder (or printing form) bearing printing plates on which patterns to be printed are drawn and a blanket cylinder (or transfer cylinder) bearing a blanket. The blanket cylinder and the plate cylinder rotate bearing against each other, the blanket being in contact with the printing plates. The blanket is also in contact with the strip of material. The blanket removes the ink present on the plates and transfers it onto the strip of material while printing the patterns thereon.

The printing plates are removably fixed on the plate cylinder. Each printing plate is flexible so as to wind around the plate cylinder. Each printing plate comprises a front end and a back end parallel to the axis of the plate cylinder and lateral edges provided to extend along the circumference of the plate cylinder. Each printing plate is fixed on the plate cylinder by its front edge and its rear edge.

Printing plates are loaded on the plate cylinder for each printing job. It is possible to load printing plates using an automatic loading device guiding the printing plates by the lateral edges using lateral guidance during winding on the circumference of the plate cylinder.

Nevertheless, with such a printing plate loading device, the lateral edges of the printing plates must have a precise geometry and, in the event printing plates of different widths are used, for example in the event of reel width changes, it is necessary to adapt the position of the lateral guides.

One of the aims of the invention is to propose a simple plate loading device that makes it possible to load plates with different widths.

To that end, the invention proposes a loading device for loading a printing plate on a plate cylinder of a rotary offset press, comprising a magazine for receiving at least one printing plate and transferring it from the magazine to the plate cylinder, characterized in that it comprises at least one guide rail to guide a printing plate during transfer thereof by cooperation with a notch of a front edge of the printing plate, the notch sliding along the guide rail during the transfer.

According to other embodiments, the loading device comprises one or more of the following features, considered alone or according to all technically possible combinations:

- each guide rail is provided to engage with a notch of a front edge designed to engage with an indexing slug provided on the plate cylinder for lateral positioning of the printing plate along the plate cylinder;
- the loading device comprises at least one push-piece to push the or each printing plate received in a magazine toward the outlet of the magazine;
- the magazine comprises several parallel guide rails laterally spaced apart;
- the guide rails are in a fixed position;
- the magazine comprises a support plate configured to receive at least one printing plate placed on one surface of the support plate, the guide rails being fixed on said surface.

The invention also relates to a printing assembly for a rotary offset press comprising a plate cylinder and a loading device for loading printing plates on the plate cylinder, in which the plate cylinder comprises at least one fastening slot for inserting and fastening front and rear edges of printing plates, each fastening slot comprises indexing slugs arranged in the fastening slot, each to be inserted into a notch of a front edge of the printing plate, the magazine is arranged such that the outlet extends along the plate cylinder and each guide rail is aligned with a respective indexing slug.

The invention also relates to a rotary offset press comprising at least one printing assembly as defined above.

The invention also relates to an assembly of sets of printing plates for a printing assembly as defined above, comprising at least two sets of printing plates, the printing plates of each set being capable of being arranged and fixed side-by-side along the plate cylinder, the set comprising at least one printing plate with a width different from that of at least one printing plate of the other set.

Advantageously, each of the two sets of printing plates has printing plates with the same width different from that of the printing plates of the other set.

The invention also relates to a set of printing plates for a printing assembly as defined above, comprising printing plates capable of being arranged and fixed side-by-side along the plate cylinder, at least two printing plates having different widths, in particular at least one printing plate having a width twice the size of that of the other printing plate of the set. The set of printing plates may comprise at least two one-page printing plates and at least one two-page printing plate with a width twice that of the one-page printing plates.

The invention also relates to a set of printing plates for a printing assembly as defined above, comprising printing plates provided to be fixed side-by-side along the plate cylinder, at least two printing plates having the same width and comprising notches formed in their folded front edges, the lateral positioning of the notches along the front edge of their respective printing plates being different.

The invention also relates to a method for loading a printing plate on a plate cylinder of a rotary offset press, the printing plate comprising a front edge designed to be inserted into a slot of the plate cylinder to fasten the printing plate on the plate cylinder, the front edge having a notch provided to be engaged with an indexing slug in the slot, in which the printing plate is transferred from a magazine to the plate cylinder by guiding the printing plate along a guide rail cooperating with the notch of the front edge, the guide rail is aligned with the indexing slug.

The invention and the advantages thereof will be better understood upon reading the following description, provided solely as an example and done in reference to the appended drawings, in which.

Figure 1:
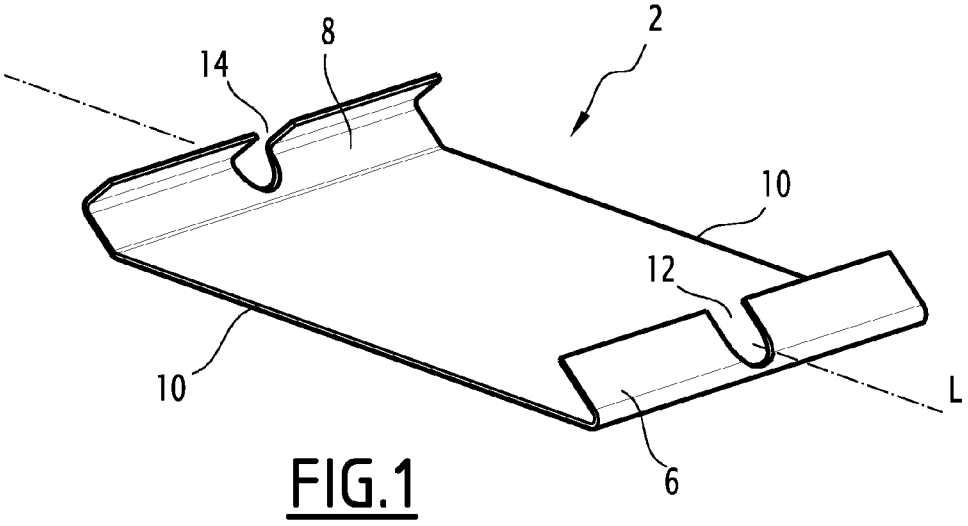
FIG. 1 is a diagrammatic perspective view of a printing plate.

The printing plate 2 shown in FIG. 1 extends in an extension direction L and comprises a folded front edge 6 and a folded rear edge 8. The front edge 6 and the rear edge 8 extend transversely to the extension direction L. The printing plate 2 comprises two opposite parallel lateral edges 10. The lateral edges 10 extend along the extension direction L.

The front edge 6 is provided with a front notch 12. The rear edge 8 is provided with a rear notch 14. The rear notch 14 is aligned with the front notch 12 along the extension direction L.

Figure 2:
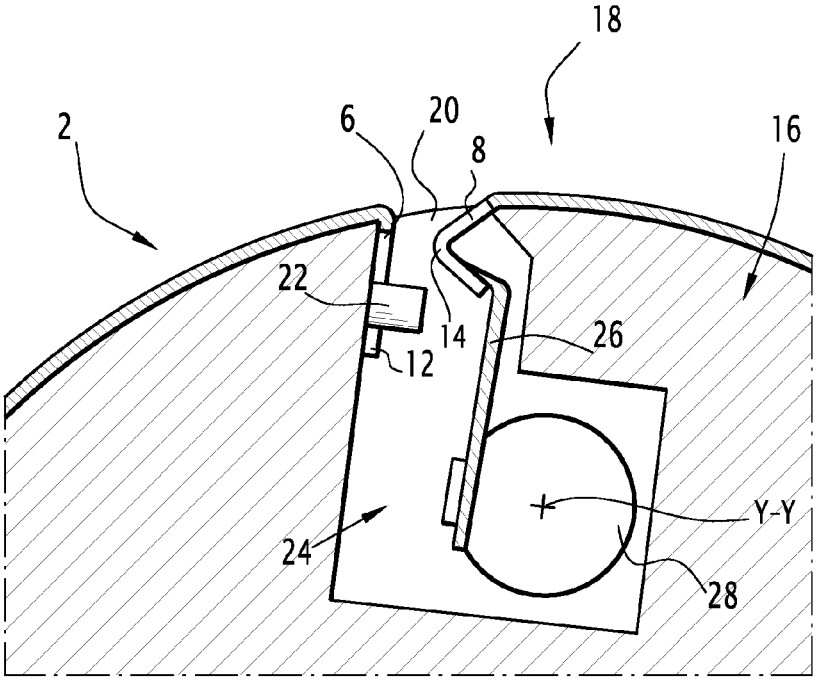
FIG. 2 is a diagrammatic partial cross-sectional view of a plate cylinder on which a printing plate is fixed.

As illustrated in FIG. 2, the printing plate 2, which is flexible, is wound and fixed on a plate cylinder 16 of the rotary press 18.

The printing plate 2 is fixed on the plate cylinder 16 by inserting each of the front edge 6 and the rear edge 8 into a slot 20 of the plate cylinder 16 extending along the axis X-X of the plate cylinder 16.

The printing plate 2 is laterally positioned along the axis X-X of the plate cylinder 16 by engaging the front notch 12 with an indexing slug 22 in the slot 20.

The front edge 6 is attached on an edge of the slot 20 and the rear edge 8 is inserted into the slot 20 while being retained therein by a locking device 24 to lock the printing plate 2 on the plate cylinder 16.

The locking device 24 comprises at least one hook 26 mounted on a locking bar 28 rotating around a bar axis Y-Y parallel to the axis X-X of the plate cylinder 16. Rotating the locking bar 28 makes it possible to free the hook 28 from the rear edge 8 to free the printing plate 2 or to engage the hook 26 with the rear edge 8 to lock the printing plate 2. In FIG. 2, the hook 26 is withdrawn from the cutting plane and offset relative to the rear notch 14.

In a plate cylinder with one printing plate per revolution, the plate cylinder comprises a single fastening slot and the front edge and the rear edge are fixed in the same slot. In a plate cylinder with N plates per revolution, N being greater than or equal to 2, the plate cylinder comprises N slots, and the front edge and the rear edge of each printing plate are fixed in a respective slot.

Figure 3:
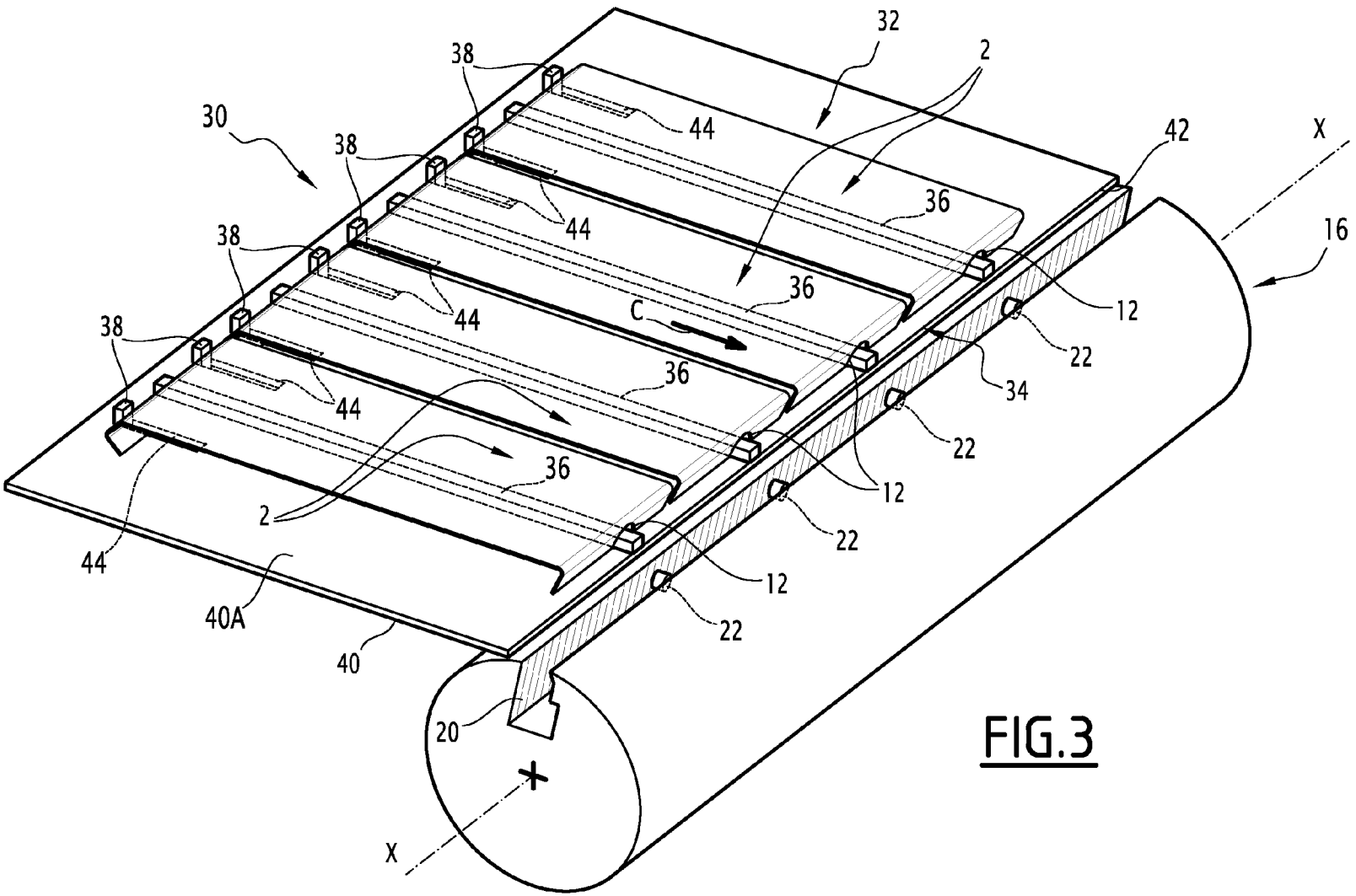
FIG. 3 is a partial diagrammatic perspective view of the plate cylinder of FIG. 2 and a device for loading printing plates on the plate cylinder.
Figure 4:
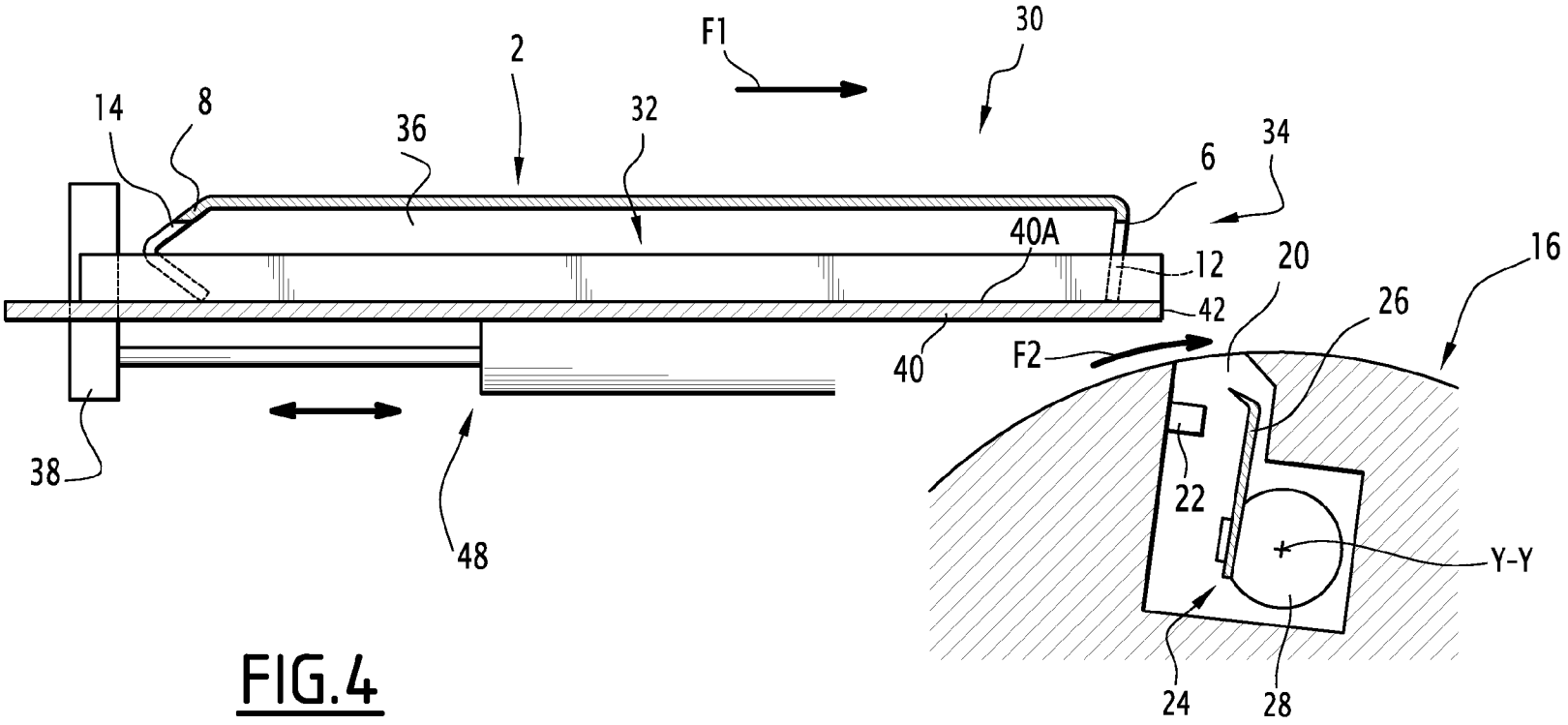
FIG. 4 is a partial diagrammatic cross-sectional view illustrating the loading of a printing plate on the plate cylinder using the loading device.

As illustrated in FIGS. 3 and 4, the loading device 30 comprises a magazine 32 for receiving printing plates 2 and transferring the printing plates 2 onto the plate cylinder 16. The magazine 32 can receive several printing plates 2 side-by-side along the plate cylinder 16.

The magazine 32 comprises an outlet 34 extending along the plate cylinder 16 along the axis X-X of the plate cylinder 16. The magazine 32 is configured such that printing plates 2 received in the magazine are placed simply bearing in the magazine 32 and can slide from the magazine 32 in a loading direction C, through the outlet 34, and wind on the plate cylinder 16.

The loading direction C is substantially orthogonal to the axis X-X of the plate cylinder 16.

The magazine 32 comprises guide rails 36. The guide rails 36 are parallel to each other and to the loading direction C. They are rectilinear and extend toward the outlet 34.

The guide rails 36 are configured to cooperate with the front 12 and rear 14 notches (FIG. 4), respectively, of the front 6 and rear 8 edges of the printing plates 2 received in the magazine 32 to guide the printing plates 2 laterally when they are transferred onto the plate cylinder 16.

The height of the guide rails 36 is smaller than the height of the notches 12, 14. When the printing plate is placed in the magazine in the standby position, the guide rails 36 do not interfere with the bottom of the notches 12, 14 and the printing plate 2 rests in linear contact by its front 6 and rear 8 edges. This saves the printing plate 2 from any deterioration.

Each guide rail 36 is aligned with a respective indexing slug 22 associated with the plate cylinder 16, such that the front notch 12 of a front edge 6 of a printing plate 2 guided by the guide rail 36 and leaving the magazine 32 engages with the indexing slug 22. A slug 22 is aligned with each guide rail 36. Each guide rail 36 and the corresponding slug 22 are situated in a same plane perpendicular to the axis X-X of the plate cylinder 16.

The loading device 30 comprises push-pieces 38 that can be moved to push the printing plates received in the magazine 32 along the guide rails 36 toward the outlet 34.

In the illustrated example, the magazine 32 comprises a horizontal support plate 40 capable of receiving the printing plates placed on an upper surface 40A of the support plate 40. The support plate 40 has an outlet edge 42 extending along the outlet 34 of the magazine 32.

The guide rails 36 assume the form of bars fixed on the upper surface 40A and extending perpendicular to the front edge 42. A printing plate 2 placed on the support plate 40 with its front 12 and rear 14 notches engaged on a guide rail 36 can slide toward the outlet edge 42.

The push-pieces 38 are movable through slits 44 (FIG. 3) of the support plate 40 to push the printing plates 2 received on the support plate 40 toward the outlet edge 42.

As illustrated in FIG. 4, the magazine 32 comprises at least one actuator 48 for commanding the movement of the push-pieces 38. Each actuator commands the movement of one or more push-pieces 38.

The operation of the loading device 30 is described hereafter in reference to FIG. 4.

During operation, initially, printing plates are placed in the magazine 32 side-by-side. Each printing plate 2 is placed such that its front notch 12 is engaged on the guide rail 36 across from the slug 22 designed to engage in the front notch 12. The corresponding rear notch 14 is also engaged on the same guide rail 36.

The plate cylinder 16 is oriented such that the slot 20 is situated substantially vertically under the outlet 34 of the magazine 32. The hooks 26 are initially in the released position so as not to hinder the insertion of the front edge 6 and the rear edge 8 into the fastening slot 20.

To load the printing plate 2 on the plate cylinder 16, the push-pieces 38 are advanced (Arrow F1) so as to push the printing plate 2 from back to front, toward the outlet 34.

When the front edge 6 of the printing plate 2 leaves the magazine 32, it falls by gravity and is inserted into the slot 20 while engaging with the edge of the slot 20. The front notch 12 engages with the corresponding indexing slug 22, which is aligned with the guide rail 36. The printing plate 2 is precisely positioned laterally along the plate cylinder 16.

The plate cylinder 16 is rotated (Arrow F2). The plate cylinder 16 drives the printing plate 2 until the rear edge 8 leaves the magazine 32 and in turn falls into the fastening slot 20.

The hooks 26, initially in the released position, are moved into the engaged position to lock the printing plate on the plate cylinder 16.

Thus, according to a method for loading a printing plate on a plate cylinder, the printing plate 2 is transferred from the magazine 32 to the plate cylinder 16 while guiding the printing plate 2 along the guide rail 36 cooperating with the front notch 12 of the front edge 6, the guide rail 36 being aligned with an indexing slug 22 of the plate cylinder 16.

Different sets of printing plates can be loaded on the plate cylinder 12 using the loading device 30.

Figure 5:
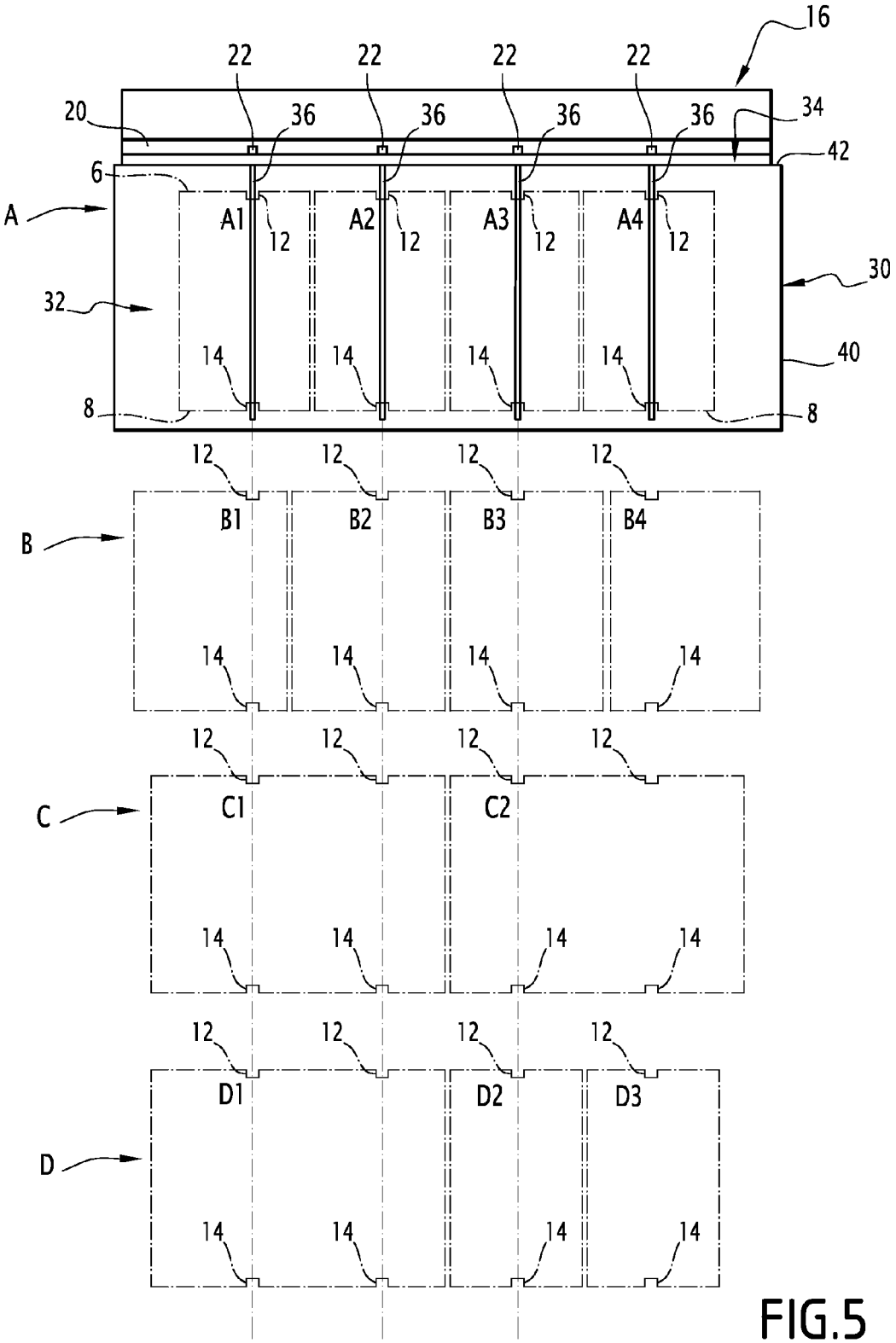
FIG. 5 is a diagrammatic top view of the plate cylinder, the loading device and sets of printing plates provided to be loaded on the plate cylinder using the loading device.

FIG. 5 diagrammatically shows a top view of the plate cylinder 16, the loading device 30, and sets of printing plates A, B, C, D that can be loaded on the plate cylinder 16 using the loading device 30.

Each set of printing plates A, B, C, D comprises several printing plates provided to be arranged side-by-side on the plate cylinder 16. Each printing plate has a least one front notch 12 designed to cooperate with an indexing slug 22 of the plate cylinder 16 and with the corresponding rail 36 of the loading device 30 to guide the printing plate when it is loaded on the plate cylinder 16.

Each set of printing plates A, B, C, D comprises printing plates with a same width or printing plates with variable widths from one printing plate to the next.

The first set of printing plates A comprises four printing plates A1, A2, A3, A4 with the same width. Each printing plate A1, A2, A3, A4 comprises a front notch 12. The front notches 12 are positioned identically along the front edges of the printing plates A1, A2, A3, A4. More specifically, each front notch 12 is centered laterally along the front edge.

The first set of printing plates A is shown loaded in the magazine 32.

The second set of printing plates B comprises four printing plates B1, B2, B3, B4 with a same width. The width of the printing plates B1, B2, B3, B4 is larger than that of the printing plates A1, A2, A3, A4, for printing on a strip of paper with a larger reel width. Each printing plate B1, B2, B3, B4 comprises a front notch 12 laterally off centered along the front edge. The position of the front notch 12 differs between the printing plates so as to be able to arrange the printing plates B1, B2, B3, B4 side-by-side along the plate cylinder 16, the indexing slugs 22 being received in the front notches 12.

The third set of printing plates C comprises two printing plates C1, C2 with a same width. Each printing plate C1, C2 comprises two front notches 12 along its front edge.

The printing plates A1, A2, A3, A4 and the printing plates B1, B2, B3, B4 are for example one-page printing plates, and the printing plates C1, C2 are for example two-page printing plates.

The fourth set of printing plates D comprises printing plates D1, D2, D3 with different widths. It more specifically comprises one two-page printing plate D1 and two one-page printing plates D2, D3, the width of the printing plate D1 being twice that of the printing plates D2, D3. The printing plate D1 comprises two front notches 12 spaced apart along its front edge, and each of the one-page printing plates D2, D3 comprises a single front notch 12.

Preferably, a single front notch 12 of a printing plate performs lateral guiding by cooperating with a guide rail 36. When the front edge 6 of the printing plate comprises two front notches 12 (for example, printing plates C1, C2 and D1), preferably, a single front notch receives the corresponding guide rail with a narrower lateral play between that front notch and the corresponding rail than the lateral play between the or each other notch and the rail corresponding to the or each other notch. Thus, the lateral guiding is performed solely by the notch having the narrowest lateral play with the corresponding rail. The or each other front notch with a greater lateral play facilitates the installation of the printing plate in the magazine and avoids blockage during sliding of the plate along the guide rails 36.

The loading device 30 makes it possible to load printing plates with different widths, without adapting the magazine 32 each time there is a change in the width of the printing plate. It is possible to alternate between the first set of printing plates A, the second set of printing plates B, the third set of printing plates C and/or the fourth set of printing plates D without any intermediate adaptation of the magazine 32. In a loading device in which the guiding of the printing plates is done by guiding the lateral edges of the printing plates, it would be necessary to modify the position of the lateral guides in the event of a change in the printing plate width.

The loading device 30 allows simple and effective guiding, without requiring a precise cut out of the lateral edges of the printing plates. In a loading device using lateral guiding, the cut out of the lateral edges of the printing plates must be very precise, which increases their manufacturing cost.

The loading device 30 is used for automatic operation, in which the push-pieces 38 are actuated to push the printing plates. It is possible to use a semi-automatic operation (plate edge 6 engaged in the slot 20 by the operator) without using the loading device 30.

The positioning of the printing plates on the plate cylinder by cooperation of the notches of the plates with indexing slugs in the slots of the plate cylinder enables manual loading of the printing plates without the loading device, since the positioning function of the printing plates is performed by the plate cylinder.

In the case of plates in a set of printing plates having front notches positioned differently along their front edge, the front notches perform a mechanical physical error-proofing function and prevent errors due to poor positioning or inversion of printing plates during the placement of the printing plates in the magazine 32.

To load N sets of printing plates on a plate cylinder with N printing plates per revolution, it is possible to provide a loading assembly comprising N loading devices as illustrated in FIGS. 3 and 4 vertically superimposed, each for loading a respective set of printing plates on the circumference of the plate cylinder.

What is claimed is:

1. A printing assembly for a rotary offset press, comprising:

a plate cylinder; and a loading device for loading printing plates on the plate cylinder, the loading device including:

a magazine for receiving at least one printing plate and transferring the printing plate from the magazine to the plate cylinder;

at least one guide rail to guide at least one of the printing plates during transfer thereof by cooperation with a notch of a front edge of the at least one printing plate, the notch sliding along the guide rail during the transfer, each guide rail being provided to engage with a notch of a front edge designed to engage with an indexing slug provided on the plate cylinder for lateral positioning of the printing plate along the plate cylinder;

the plate cylinder comprising at least one fastening slot for inserting and fastening front and rear edges of printing plates, each fastening slot including indexing slugs arranged in the fastening slot, each to be inserted into the notch of the front edge of the printing plate, the magazine being arranged such that an outlet extends along the plate cylinder and each guide rail is aligned with a respective indexing slug.

2. The printing assembly for a rotary offset press according to claim 1, comprising printing plates provided to be fixed side-by-side along the plate cylinder, at least two printing plates having the same width and comprising notches formed in their folded front edges, the lateral positioning of the notches along the front edge of their respective printing plates being different.

3. The printing assembly for a rotary offset press according to claim 1, further comprising at least one push-piece to push each printing plate received in a magazine toward the outlet of the magazine.

4. The printing assembly for a rotary offset press loading device according to claim 1, wherein the magazine-includes several parallel guide rails laterally spaced apart.

5. The printing assembly for a rotary offset press according to claim 1, wherein the guide rails are in a fixed position.

6. The printing assembly for a rotary offset press according to claim 1, wherein the magazine includes a support plate configured to receive at least one printing plate placed on one surface of the support plate, the guide rails being fixed on the surface.

7. A rotary offset press comprising at least one assembly according to claim 1.

8. The printing assembly for a rotary offset press according to claim 1, comprising:

at least two sets of printing plates, the printing plates of each set being capable of being arranged and fixed side-by-side along the plate cylinder, the set comprising at least one printing plate with a width different from that of at least one printing plate of the other set.

9. The printing assembly for a rotary offset press according to claim 8, each of the two sets of printing plates having printing plates with the same width different from that of the printing plates of the other set.

10. The printing assembly for a rotary offset press according to claim 1, comprising printing plates capable of being arranged and fixed side-by-side along the plate cylinder, at least two printing plates having different widths.

11. The printing assembly for a rotary offset press according to claim 10, comprising at least two one-page printing plates and at least one two-page printing plate with a width twice that of the one-page printing plates.

12. The printing assembly for a rotary offset press according to claim 10, in wherein at least one printing plate has a width twice the size of that of another printing plate of the set.

13. A method for loading a printing plate on a plate cylinder of a rotary offset press, the printing plate comprising a front edge designed to be inserted into a slot of the plate cylinder to fasten the printing plate on the plate cylinder, the front edge having a notch provided to be engaged with an indexing slug in the slot, in which the printing plate is transferred from a magazine to the plate cylinder by guiding the printing plate along a guide rail cooperating with the notch of the front edge, the guide rail being aligned with the indexing slug.

* * * * *